US006575426B2

(12) United States Patent
Sundararajan

(10) Patent No.: US 6,575,426 B2
(45) Date of Patent: Jun. 10, 2003

(54) VALVE SYSTEM AND METHOD

(75) Inventor: Alagarsamy Sundararajan, Katy, TX (US)

(73) Assignee: Worldwide Oilfield Machine, Inc., Houston, TX (US)

( * ) Notice: Subject to any disclaimer, the term of this patent is extended or adjusted under 35 U.S.C. 154(b) by 68 days.

(21) Appl. No.: 09/925,676

(22) Filed: Aug. 9, 2001

(65) Prior Publication Data

US 2003/0030017 A1 Feb. 13, 2003

(51) Int. Cl.[7] ..... F16K 31/00
(52) U.S. Cl. ..... 251/14; 251/63.5; 251/326
(58) Field of Search ..... 251/14, 326, 327, 251/329, 328, 63.5

(56) References Cited

U.S. PATENT DOCUMENTS

| | | | | | |
|---|---|---|---|---|---|
| 2,991,042 | A | * | 7/1961 | Natho | 251/14 |
| 3,378,224 | A | * | 4/1968 | Boyle | 251/14 |
| 3,765,642 | A | * | 10/1973 | Nelson | 251/14 |
| 3,842,854 | A | * | 10/1974 | Wicke | 251/14 |
| 4,212,355 | A | * | 7/1980 | Reardon | 251/352 |
| 4,213,480 | A | | 7/1980 | Orum et al. | |
| 4,230,299 | A | * | 10/1980 | Pierce, Jr. | 251/14 |
| 4,240,455 | A | * | 12/1980 | McGee | 251/14 |
| 4,436,279 | A | * | 3/1984 | Bonds et al. | 251/14 |
| 4,437,521 | A | | 3/1984 | Richardson et al. | |
| 4,619,434 | A | * | 10/1986 | Snyder et al. | 251/14 |
| 4,650,151 | A | | 3/1987 | McIntyre | |
| 4,809,733 | A | * | 3/1989 | Hawkins | 251/14 |
| 4,827,963 | A | * | 5/1989 | Baker et al. | 251/14 |
| 4,836,243 | A | * | 6/1989 | Ferrell | 251/14 |
| 4,921,207 | A | | 5/1990 | Baker | |

* cited by examiner

*Primary Examiner*—Ehud Gartenberg
*Assistant Examiner*—John Bastianelli
(74) *Attorney, Agent, or Firm*—Kenneth L. Nash

(57) ABSTRACT

A valve system and method is disclosed that includes, in one preferred embodiment, a compact valve system that may be configured in many different ways so as to be especially suitable for conforming to the dimensional requirements of many particular subsea installations such as lower riser packages. Thus, the height of the hydraulic actuator and/or manual override operators can be varied depending on the necessary configuration. However, operation of the manual override operators is the same as previously utilized subsea manual override operators. In one presently preferred embodiment, a hydraulic actuator which may be a fail-safe actuator, is connected to a gate valve utilizing an operating stem which extends through a first bonnet secured to one side of a gate valve body. A moveable gate is attached to the operating stem and is therefore operably connected for control by the hydraulic actuator. On an opposite side of the gate valve body, a second bonnet is secured. Attached to the second bonnet is a manual override operator having a rotary drive shaft and slave member. The slave member is attached to a balance stem which is secured to an opposite side of the gate with respect to the operating stem. The rotary drive shaft and slave member comprise reverse threads to thereby operate in the same manner as if the manual override operator were operably secured to the hydraulic actuator. The valve body is preferably symmetrical such that the position of the hydraulic actuator and manual override operator could be switched, if desired.

28 Claims, 1 Drawing Sheet

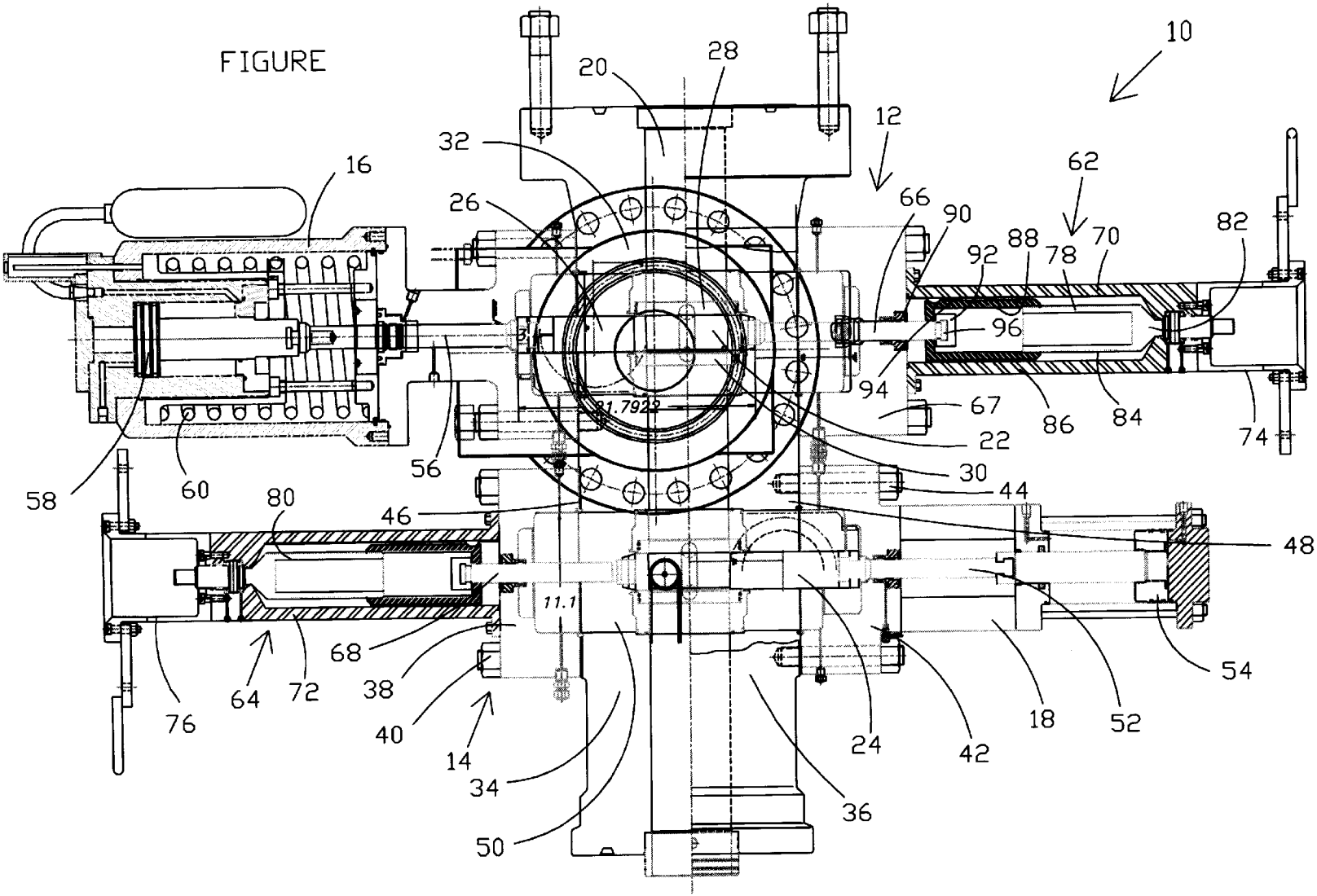
FIGURE

VALVE SYSTEM AND METHOD

BACKGROUND OF THE INVENTION

1. Field of the Invention

The present invention relates generally to valve systems and, in a particular embodiment, to apparatus and methods for a compact subsea valve system that is highly suitable for deep water installations wherein installation dimensions are limited.

2. Description of the Background

Remote subsea gate valves and fail-safe gate valves are typically controlled with hydraulic actuators and may comprise a lower riser package. The hydraulic actuators and often their controls may be located on or near the ocean floor along with other equipment. Due to the cost and limited space when positioning equipment on the ocean floor, it is highly desirable that any equipment be as compact as possible while still affording excellent reliability and simplified maintenance procedures. Thus, the valve equipment must typically fit within a relatively small frame, with limited subsea valve installation dimensions, that may be lowered to the sea floor for subsea operation.

In case hydraulic power is lost for some reason, a manual override control may be necessary for valve operation. The potential for loss of hydraulic power is also met by providing a fail-safe hydraulic actuator which moves the gate valve to a preselected position should hydraulic power fail. While manual override controls, hydraulic actuators, and fail-safe hydraulic actuators are commonly utilized in subsea installations, such devices further increase the size of the valve assemblies. My previous U.S. patent application Ser. No. 09/802,209, filed Mar. 8, 2001, and incorporated herein by reference, discloses an exemplary hydraulic fail-safe actuator and manual override control having significantly reduced dimensions that may be used in an underwater installation in accord with the present invention. In this application, even further unique improvements are disclosed for yet more substantial reductions in overall subsea valve system dimensions.

Manual override controls may be manually operated by divers or by remotely controlled underwater vehicles (ROVS) and are commonly operated in a standard manner. Thus, any operation of valves by divers or ROVS to override the use of the standard hydraulic valve actuators is considered manual operation of the valve for purposes of the present invention. Typically, such operation involves rotation of a shaft or wheel. In accord with the present invention, it is desirable that even highly compact valve systems as taught herein, including corresponding manual override controls, may be operated according to standard operating procedures to avoid the need to operate different manual override controls in different ways and so thereby avoid confusion.

Previously available deepwater valve installations tend to have numerous limitations including bulky dimensions. Consequently, there remains a need for a compact subsea valve system that offers dependable operation at deep water depths, reduces the size of the overall subsea valve system, provides manual override controls which may be utilized in conjunction with both fail-safe actuators and other types of hydraulic actuators, and significantly increases valve system configuration flexibility. Those skilled in the art have long sought and will appreciate the present invention which addresses these and other problems.

SUMMARY OF THE INVENTION

The present invention is embodied in a design for a subsea gate valve system and method that allows more reliable and improved operation within reduced installation dimensions for any practical water depth, e.g., 10,000 feet.

Thus the present invention provides for a subsea gate valve assembly which may comprise one or more elements such as, for instance, a gate valve housing, a gate element moveably mounted within the gate valve housing, the gate element having a first side and a second side, a valve operating stem connected with respect to the first side of the gate element, a hydraulic actuator housing secured with respect to the gate valve housing, a hydraulically activated element mounted within the hydraulic actuator housing and operatively connected with the operating stem for moving the valve operating stem and the gate element between a first position and a second position, a balance stem secured with respect to the second side of the gate element, a manual override housing secured with respect to the gate valve housing, and/or a manually activated member mounted within the manual override housing and operatively connected to the balance stem for moving the gate element between the first position and the second position.

In one embodiment, the manually activated member within the manual override housing comprises a threaded portion, the threaded portion may comprise reverse cut threads. The subsea valve may further comprise a second moveable element mounted within the manual override housing having a second threaded portion wherein the second portion may comprise reverse cut threads and the first threaded portion engages the second threaded portion.

Preferably, at least one of the manually activated members or the second moveable element is rotatable. The subsea valve assembly may further comprise a rib for interconnection with the manual override housing and for engaging at least one of the manually activated member or the second moveable element to prevent rotation with respect to the manual override housing. The manually activated member within the manual override housing may further comprise an override drive shaft wherein the override drive shaft is rotatably mounted within the manual override housing. In one embodiment, an override slave member has a second threaded portion and is slidably mounted within the manual override housing to thereby move longitudinally in response to rotation of the override drive shaft.

The gate valve housing may further comprise a valve body, a first gate valve bonnet secured to the valve bonnet wherein the hydraulic actuator housing may be secured to the first gate valve bonnet, and a second gate valve bonnet secured to the valve body wherein the manual override housing may be secured to the second gate valve bonnet.

The valve body may have a first side and a second side. In one embodiment, the first gate valve bonnet may be attachable to the first side or the second side and the second gate valve bonnet may be attachable to the first side or the second side.

A manual override control for a subsea valve assembly may comprise a manual override housing, a manual override drive shaft rotatably mounted within the manual override housing, the manual override drive shaft having a first threaded portion, the first threaded portion may comprise left-handed threads wherein a manual override slave member operatively connected to the manual override drive shaft and the gate.

Preferably, the manual override slave member has a second threaded portion with left-handed threads engageable with the first portion such that the gate is translationally moveable between the first position and the second position in response to rotation of the manual override drive shaft.

The manual override control may further comprise at least one rib and at least one slot defined between the slave member and the manual override housing wherein the at least one slot receives the at least one rib to thereby permit translational movement of the slave member with respect to the manual override housing and to thereby prevent rotational movement of the slave member with respect to the manual override housing. In one embodiment, the rib is affixed to the manual override housing and the slot is defined within the slave member.

Moreover, the manual override control may further comprise a rotational connection between the manual override drive shaft and the manual override housing such that the rotational connection permits rotational movement of the manual override drive shaft with respect to the manual override housing and prevents translational movement of the manual override drive shaft with respect to the manual override housing.

Thus, the present invention provides a method for assembling a gate valve assembly which method may comprise one or more steps such as, for instance, inserting a gate valve into a gate valve housing, attaching an operating stem to the gate valve, attaching a balance stem to the gate valve, connecting a hydraulic operator to the operating stem, and/or connecting a manual override operator to the balance stem. If desired, the hydraulic operator may be a hydraulic fail-safe actuator or may be another type of hydraulic actuator. The method may further comprise providing a manual override housing for the manual override operator, and/or attaching the manual override housing to the gate valve housing. Additional steps may include providing a first left-handed threaded portion on a rotatable member and/or mounting the rotatable member within the manual override housing. Yet additional steps may comprise mounting a slave member for translational movement within the manual override housing, providing a second left-handed threaded portion on the slave member, engaging the first left-handed threaded portion with the second left-handed thread portion, and/or interconnecting the balance stem to the slave member.

Additionally, the method may comprise forming the gate valve housing by attaching a first gate valve bonnet to a first side of a gate valve body, and/or attaching a second gate valve bonnet to a second side of the gate valve body. Other assembly steps may comprise attaching the hydraulic operator to the first gate valve bonnet, attaching the manual override operator to the second gate valve bonnet, extending the operating stem through the first gate valve bonnet, and/or extending the balance stem through the second gate valve bonnet.

In one preferred embodiment, the method comprises providing that the first side of the gate valve body and the second side of the gate valve body are substantially symmetrical such that the first gate valve bonnet is selectively connectable to the first side of the gate valve body or the second side of the gate valve body.

A method for assembly a manual override control for a subsea valve actuator assembly is also provided and may comprise providing a manual override drive shaft with a threaded portion having left-handed threaded portion, rotatably mounting the manual override drive shaft within a manual override housing, mounting a connector element within the manual override housing for connecting with the gate, and/or mounting the override drive shaft with respect to the connector element such that rotational movement of the drive shaft results in translational movement of the connector element. The method may further comprise providing the connector element with a threaded portion for engaging the left-handed threaded portion of the drive shaft, and/or affixing a rotational connection to the manual override housing, and/or interconnecting the manual override drive shaft to the rotational connection such that the manual override drive shaft is rotatable with respect to the manual override housing but is prevented from rotational movement with respect thereto.

In one embodiment, a subsea gate valve assembly may comprise a gate valve housing with a first gate valve housing side and a second gate valve housing side opposite to the first gate valve housing side, a gate element moveably mounted within the gate valve housing for movement between a first position and a second position, a hydraulic actuator housing mounted to the first gate valve housing side, a hydraulically activated element mounted within the hydraulic actuator housing and operatively connected to the gate element for moving the gate element between the first position and a second position, a manual override housing mounted to the second gate valve housing side, and a manually activated member mounted within the manual override housing and operatively connected to the gate element for moving the gate element between the first position and the second position.

It is an object of the present invention to provide an improved subsea valve system and method.

It is another object of the present invention to provide a subsea valve system with a more compact configuration.

An advantage of the present invention is the significant size (height and weight) reduction achieved by a design in accord with the invention.

Another advantage of the present invention is increased flexibility in valve system configuration.

These and other objects, features, and advantages of the present invention will become apparent from the drawings, the descriptions given herein, and the appended claims.

BRIEF DESCRIPTION OF THE DRAWINGS

The FIGURE is an elevational view, partially in section, of a subsea valve assembly in accord with the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

BRIEF DESCRIPTION OF THE PREFERRED EMBODIMENTS

Referring now to the drawings, and more particularly to the FIGURE, there is shown a subsea valve assembly 10, in accord with the present invention. Due to the physical space limitations, it is desirable that subsea valve assembly 10 be as compact as possible.

Subsea valve assembly 10 may include one or more gate valves, such as gate valve 12 and gate valve 14. Various types of hydraulic gate valve actuators may be utilized within subsea valve assembly 10, such as fail-safe gate valve actuator 16 and hydraulic actuator 18. An exemplary embodiment of a fail-safe gate valve actuator is disclosed in U.S. patent application Ser. No. 09/802,209, filed Mar. 8, 2001, referenced hereinbefore, and incorporated herein by reference. Gate valves 12 and 14 are utilized to control fluid flow through conduit 20 which is part of a subsea installation. Subsea valve assembly 10 shown in the FIGURE is of a type that may be utilized in very deep water.

Gate valve 12 comprises a slidable gate 22 and gate valve 14 comprises a slidable gate 24. Gates 22 and 24 are each individually moveable between an open position and a closed position whereby fluid flow through conduit 20 may be controlled. Gate 22 includes passageway 26 therethrough such that in the position shown gate 22 is in the closed position. Seat elements 28 and 30 work with gate 22 for sealing and opening passageway 20. Likewise, gate 24 is shown in the open position to thereby permit fluid flow through passageway 20. In many cases, it may be desirable to include both a hydraulic actuator gate valve and a failsafe hydraulic actuator for ensuring that fluid flow through conduit 20 is properly controlled if hydraulic power is lost.

Gate valve 12 includes gate valve housing 32 and gate valve 14 includes gate valve housing 34. The gate valve housings may be constructed in different ways. However, a preferred embodiment of the present invention provides for a gate valve housing comprised of a gate valve body which is symmetrical on both sides for attachment to two gate valve bonnets. Thus gate valve housing 34 comprises gate valve body 36 which includes a first gate valve bonnet 38 secured by connectors such as stud/nut assemblies 40 to gate valve body 36. Gate valve housing 34 also includes a second gate valve bonnet 42 which is secured by stud/nut assemblies 44 to gate valve body 36. In this presently preferred embodiment, gate valve body 36 is substantially symmetrical on each side such that either gate valve bonnet may attach to either symmetrical side 46 or symmetrical side 48 of gate valve body 36. While not required, this symmetrical construction permits significant flexibility of design whereby hydraulic actuators and/or manual override operators, as discussed subsequently, may be positioned as desired on whichever side of the gate valve most suitable for the particular dimensional requirements.

The gate valve housings include a chamber defined therein in which the gate moves. Thus, gate valve housing 34 defines chamber 50 in which gate 24 moves translationally between the open and closed position in response to action of hydraulic actuator 18. Gate 24 is controlled by hydraulic actuator 18 by means of operating stem 52. Piston 54 is hydraulically activated to control operating stem 52 which in turn controls the position of gate 24. Likewise, failsafe actuator 16 connects to operating stem 56 and operates as described in detail in my above referenced previous patent application in response to hydraulic activation of piston 58 and/or control spring 60. Usually, a failsafe valve is either a normally open valve or a normally closed valve, depending on the requirement, such that if failure occurs then the valve returns to the desired position.

In general, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. One of skill in the art upon reviewing this specification will understand that the relative size and shape of the components may be greatly different from that shown and the invention can still operate in accord with the novel principals taught herein.

Valve system 10 preferably also utilizes manual override operators such as manual override operators 62 and 64 which operate in conjunction with fail-safe hydraulic actuator 16 and hydraulic actuator 18, respectively. Each manual override operator is preferably mounted to one of the two gate valve bonnets. Thus, manual override operator 64 is mounted to gate valve bonnet 38. Manual overrride operator 62 is mounted to gate valve bonnet 67 preferably in the same manner as discussed previously. Because the opposing bonnets, such as bonnets 38 and 42 may be connected to either of the opposite sides 46 and 48 of gate valve body 36, the respective manual override operator and actuator, such as manual override actuator 64 and hydraulic actuator 18 may be positioned on either side of valve body 36. In this way, the flexibility of subsea valve system 10 is significantly enhanced and provides significant flexibility of design.

Manual override operators 62 and 64 are therefore mounted on an opposite side of the gate valve with respect to the hydraulic actuator. By this placement in accord with the present invention, the overall size of valve system 10 is greatly reduced. My prior application shows mounting an exemplary compact manual override operator onto an actuator. In this application, my invention provides a manual override operator that is not directly connected to the actuator but is instead positioned on an opposite side of the gate valve as shown in FIG. 1. By positioning the manual override operator in this manner, it will be understood by those of skill in the art that space is much more efficiently utilized. This is especially true for a preferred subsea valve system 10 construction which may require the valve housing be positioned at a center position for controlling flow through a conduit, such as conduit 20, and having only a limited amount on either side of conduit 20.

Preferably, manual override operator 62 and 64 operate in the same manner as other possible override operators that may be mounted directly to a respective actuator. The present invention permits such operation by utilizing reverse cut threads and by utilizing a balance stem. Thus, gate valve 12 also comprises balance stem 66 and gate valve 14 comprises balance stem 68. Balance stems generally have the additional purpose of providing pressure balancing for deep water operation.

Balance stem 66 connects to an opposite side of gate 22 from operator stem 56. Likewise balance stem 68 connects to an opposite side of gate 24 as compared to operator stem 52. Preferred connections to the gate that provide additional features such as seals and so forth are discussed in my previous application.

While various constructions of manual override operators may be provided, in the present embodiment the manual override operator comprises a manual override housing such as housing 70 or 72. A rotatable element, which may be activated either by divers or by remotely operated vehicles (ROV), such as rotatable element 74 or 76 is provided. Rotatable element 74, for instance, is utilized to rotate manual override shaft 78. Rotatable element 76 may likewise rotate manual override shaft 80.

Since the two manual override operators are substantially the same, the present discussion will cover manual override operator 62 and it will be understood that manual override 64 operates in a similar manner. Rotary connector 82 is utilized to rotatably secure manual override shaft 78 within manual override housing 70 such that manual override shaft 78 is rotatable with respect to manual override housing 70 but preferably is prevented from translational and/or longitudinal movement within manual override housing 70. Manual override shaft 78 has a threaded portion 84 along an outer periphery of override drive shaft 78. The threads of threaded portion 84 mate with corresponding threads of threaded portion 88 on an inner side of override slave member 86. Thus, override slave member 86 is threadably connected to manual rotary shaft 78 and is prevented from rotation as discussed subsequently but is free to move translationally or along its axis. Therefore, override slave member 86 reciprocates or moves translationally or along its longitudinal axis when manual override rotary drive shaft 78 is rotated. Preferably the threads of threaded portion 84 and the corresponding mating threads of threaded portion 88 are reverse cut or left-handed threads. Thus, it will now be appreciated by those of skill in the art that rotational operation of manual override operator 62 will be exactly the same as if the manual override operator were located on the actuator as occurs in the prior art. While this embodiment shows threads on an outer surface of threaded portion 84 of rotary drive shaft 78 and on the inner surface of threaded portion 88 of override slave member 86, it will be understood that other mechanical constructions could also be utilized whereupon the end result is that rotation of operator 74 will result in translational movement of balance stem 66 and, accordingly, gate 22. Thus, if manual operation of gate valve 12 and/or gate valve 14 is desired or required, the corresponding manual override operator can be utilized for this purpose.

Override slave member 86 engages balance stem 66 which slidably extends through opening 90 in the gate valve bonnet 67. As override slave member 86 moves translationally or along its axis, then gate 22 also moves translationally or along its axis. If a manual override is not desired, then a closed bonnet can be installed and/or a suitable plug may be secured to bonnet 67. For deepwater applications, a balance stem may preferably be desirable regardless of whether a manual override operator in accord with the present invention is utilized and a housing of some type such as manual override housing may be utilized. While various types of connectors may be utilized for attaching override slave member 86 to balance stem 66, a preferred embodiment utilizes inserts to connect to the T-slot end 96 of balance stem 66 is utilized. The inserts may be releasable by pins, retractable elements, or the like (not shown).

In this embodiment of the invention, one or more rib/slot connections, such as rib/slot connection 94, may be utilized to prevent rotation of manual override slave member 86 to thereby require manual override slave member 86 to move translationally as manual override drive shaft 78 is rotated. In this particular embodiment, the rib is mounted to manual override housing 70 and the mating slot is formed on override slave member 86. However, this construction could be reversed and/or other means to effect the same mechanical operation could be utilized.

If desired, various types of indicators may be utilized to indicate the position of the manual override operator and/or the position of the actuator. My previous application discusses a few of such indicators including highly compact position indicators.

Thus, when assembling valve assembly 10, the operator has wide flexibility of where to position the manual override operator as well as where to position the hydraulic actuators.

In the embodiment shown, the manual override operators are positioned on opposite sides of the gate valves from the hydraulic operators. Since the valve body is symmetrical, the position of the manual override operator and hydraulic actuator can be reversed if necessary to fit the desired dimensional requirements. If necessary, the manual override operator could also be positioned on the actuator as described in my previous application. Therefore, it will be understood that the present invention provides considerable flexibility of operation.

To operate the manual override operator in accord with the present invention, element 74 may be rotated by a diver or ROV in a manner well known in the prior art. Since the threaded portions 88 and 84 comprise reverse cut or left-handed threads, the operation is exactly the same as if standard or right-handed threads were utilized and the manual override assembly were mounted directly to the actuator an exemplary example of which is shown in my previous application. However, instead of pushing the gate to the desired position through the operating stem, the action involves pulling the gate to the desired position by means of balance stem 66. Rotation of element 74 results in rotation of override drive shaft 78, which is rotatably mounted but is prevented from translational movement along its axis. Rotation of override drive shaft causes rotation of threaded portion 84 which in turn causes translational movement of manual override slave member 86. Manual override slave member 86 cannot rotate but can move translationally along its axis. Since manual override slave member 86 is connected to balance stem 66 by means of inserts 92 and T-slot connector 96, balance stem 66 must move in response to movement of override slave member 86. In turn, gate 22 is secured to balance stem 66 and must move in response thereto.

Operation of the hydraulic operators is known in the prior art and operation of an exemplary hydraulic fail safe operator, such as fail-safe operator 16, is discussed in some detail in my previous application. It will be noted again that directions are used only for convenience of understanding with respect to the figures and that the actuators may be oriented in various ways which will not affect reliable operation of the present invention so that such directions as used are not intended to be limiting in any way. While the present invention preferably provides a subsea actuator, the same principles of operation could be used in other actuators such as surface actuators. It will also be understood that depending on the water depth, suitable modifications may be made, e.g., a different seals and/or relief valves and so forth may be used in the valve system such as in the valve bonnet, manual override housing, actuator housing, and the like. Moreover, a housing for an actuator, valve, or the like may include various portions or components that may or may not comprise part of another housing used for another purpose and so a housing is simply construed as a container for certain components, for example an actuator housing is a container or body for actuator components, that may be constructed in many ways and may or may not also comprise a housing of a different type such as a valve housing.

While the present invention is described in terms of a subsea valve system especially suitable for a lower riser package, the valve system of the present invention may be utilized in surface valve systems, pipelines, and any other applications, if desired.

The foregoing disclosure and description of the invention is illustrative and explanatory thereof, and it will be appreciated by those skilled in the art, that various changes in the size, shape and materials as well as in the details of the illustrated construction or combinations of features of the various coring elements may be made without departing from the spirit of the invention.

What is claimed is:

1. A gate valve assembly, comprising:

a gate valve housing;

a gate element moveably mounted within said gate valve housing, said gate element having a first side and a second side;

a valve operating stem connected with respect to said first side of said gate element;

a hydraulic actuator housing secured with respect to said gate valve housing;

a hydraulically activated element mounted within said hydraulic actuator housing and operatively connected with said operating stem for moving said valve operating stem and said gate element between a first position and a second position;

a balance stem secured with respect to said second side of said gate element;

a manual override housing secured with respect to said gate valve housing; and a manually activated member mounted within said manual override housing and operatively connected to said balance stem for moving said gate element between said first position and said second position.

2. The valve assembly of claim 1, wherein said manually activated member within said manual override housing comprises a threaded portion, said threaded portion comprising reverse cut threads.

3. The valve assembly of claim 2, further comprising a second moveable element mounted within said manual override housing having a second threaded portion, said second threaded portion comprising reverse cut threads, said first threaded portion engaging said second threaded portion.

4. The valve assembly of claim 3, wherein at least one of said manually activated member or said second moveable element is rotatable.

5. The valve assembly of claim 4, further comprising a rib for interconnection with said manual override housing for engaging at least one of said manually activated member or said second moveable element to prevent rotation thereof with respect to said manual override housing.

6. The valve assembly of claim 2, wherein said manually activated member within said manual override housing comprises further comprises an override drive shaft.

7. The valve assembly of claim 6, wherein said override drive shaft is rotatably mounted within said manual override housing.

8. The valve assembly of claim 7, further comprising an override slave member having a second threaded portion, said second threaded portion having reverse cut threads, said override slave member being slidably mounted within said manual override housing to thereby move longitudinally in response to rotation of said override drive shaft.

9. The valve assembly of claim 1, wherein said gate valve housing further comprises:

a valve body, a first gate valve bonnet secured to said valve bonnet, said hydraulic actuator housing being secured to said first gate valve bonnet, and a second gate valve bonnet secured to said valve body, said manual override housing being secured to said second gate valve bonnet.

10. The valve assembly of claim 9, wherein said valve body has a first side and a second side, said first gate valve bonnet being attachable to said first side or said second side, said second gate valve bonnet being attachable to said first side or said second side.

11. A manual override control for a valve assembly, said valve assembly comprising a valve body and a gate translationally moveable within said valve body between a first position and a second position, said manual override control comprising:

a manual override housing;

a manual override drive shaft rotatably mounted within said manual override housing, said manual override drive shaft having a first threaded portion, said first threaded portion comprising left-handed threads;

a manual override slave member operatively connected to said manual override drive shaft and said gate.

12. The manual override control of claim 11, wherein said manual override slave member having a second threaded portion with left-handed threads engageable with said first portion such that said gate is translationally moveable between said first position and said second position in response to rotation of said manual override drive shaft.

13. The manual override control of claim 12, further comprising at least one rib and at least one slot defined between said slave member and said manual override housing, said at least one slot receiving said at least one rib to thereby permit translational movement of said slave member with respect to said manual override housing and to thereby prevent rotational movement of said slave member with respect to said manual override housing.

14. The manual override control of claim 13, wherein said at least one rib is affixed to said manual override housing and said at least one slot is defined within said slave member.

15. The manual override control of claim 14, further comprising a rotational connection between said manual override drive shaft and said manual override housing, said rotational connection permitting rotational movement of said manual override drive shaft with respect to said manual override housing and preventing translational movement of said manual override drive shaft with respect to said manual override housing.

16. A method for assembling a gate valve assembly, comprising:

inserting a gate valve into a gate valve housing;

attaching an operating stem to said gate valve;

attaching a balance stem to said gate valve;

connecting a hydraulic operator to said operating stem; and connecting a manual override operator to said balance stem.

17. The method of claim 16, wherein said hydraulic operator is a hydraulic fail-safe actuator.

18. The method of claim 16, further comprising providing a manual override housing for said manual override operator, and attaching said manual override housing to said gate valve housing.

19. The method of claim 18, further comprising providing a first left-handed threaded portion on a rotatable member, and mounting said rotatable member within said manual override housing.

20. The method of claim 19, further comprising mounting a slave member for translational movement within said manual override housing, providing a second left-handed threaded portion on said slave member, engaging said first left-handed threaded portion with said second left-handed thread portion, and interconnecting said balance stem to said slave member.

21. The method of claim 16, further comprising:

forming said gate valve housing by attaching a first gate valve bonnet to a first side of a gate valve body, and attaching a second gate valve bonnet to a second side of said gate valve body.

22. The method of claim 21, further comprising attaching said hydraulic operator to said first gate valve bonnet, and attaching said manual override operator to said second gate valve bonnet.

23. The method of claim 21, further comprising extending said operating stem through said first gate valve bonnet, and extending said balance stem through said second gate valve bonnet.

24. The method of claim 21, further comprising providing that said first side of said gate valve body and said second side of said gate valve body are substantially symmetrical such that said first gate valve bonnet is selectively connectable to said first side of said gate valve body or said second side of said gate valve body.

25. The method of claim 24, further comprising providing said connector element with a threaded portion for engaging said left-handed threaded portion of said drive shaft.

26. The method of claim 25, further comprising affixing a rotational connection to said manual override housing, ad and interconnecting said manual override drive shaft to said rotational connection such that said manual override drive shaft is rotatable with respect to said manual override housing but is prevented from rotational movement with respect thereto.

27. A gate valve assembly, comprising:

a gate valve housing having a first gate valve housing side and a second gate valve housing side opposite to said first gate valve housing side;

a gate element moveably mounted within said gate valve housing for movement between a first position and a second position;

a hydraulic actuator housing mounted to said first gate valve housing side;

a hydraulically activated element mounted within said hydraulic actuator housing and operatively connected to said gate element for moving said gate element between said first position and a second position;

a manual override housing mounted to said second gate valve housing side; and a manually activated member mounted within said manual override housing and operatively connected to said gate element for moving said gate element between said first position and said second position.

28. A gate valve assembly, comprising:

a gate valve housing a first gate valve housing side and a second gate valve housing side opposite to said first gate valve housing side, said first gate valve housing side being substantially identical to said second gate valve housing side;

a gate element moveably mounted within said gate valve housing for movement between a first position and a second position;

a hydraulic actuator housing mounted to said first gate valve housing side or said second gate housing side;

a hydraulically activated element mounted within said hydraulic actuator housing and operatively connected to said gate element for moving said gate element between said first position and said second position;

a manual override housing mounted to said first gate valve housing side or said second gate valve housing side; and a manually activated member mounted within said manual override housing and operatively connected to said gate element for moving said gate element between said first position and said second position.

* * * * *

UNITED STATES PATENT AND TRADEMARK OFFICE

CERTIFICATE OF CORRECTION

PATENT NO. : 6,575,426 B2
DATED : June 10, 2003
INVENTOR(S) : Alagarsamy Sundararajan It is certified that error appears in the above-identified patent and that said Letters Patent is hereby corrected as shown below:

Column 9,
Line 3, insert the following after "housing" -- , said gate valve housing having a first housing side and a second housing side; --
Line 6, insert the following after "side" -- , said first housing side defining a first aperture leading to said first side of said gate element, said second housing side defining a second aperture leading to said second side of said gate element; --
Lines 7 & 8, delete "a valve operating stem connected with respect to said first side of said gate element;"
Line 10, insert the following after "housing" -- , said hydraulic actuator housing being selectively mountable to said first housing side or said second housing side; --
Line 13, delete "operating stem" and replace with -- gate element --
Lines 13-14, delete "said valve operating stem and".
Lines 16-17, delete "a balance stem secured with respect to said second side of said gate element;"
Line 19, insert the following after "housing" -- , said manual override housing being selectively mountable to said first housing side or said second housing side; --
Line 22, delete "balance stem" and replace with -- gate element --
Line 56, delete "a valve body;"
Line 57, insert -- gate -- between "said" and "valve", and delete "bonnet" and replace with -- housing --.
Line 60, insert -- gate -- between “said” and “valve”, and delete “body” and replace with -- housing --.
Line 63 & 64, delete "valve body has a first side and a second side, said".
Line 65, delete "being" and replace with -- is --; insert -- housing -- between "first" and "side"; and insert -- housing -- between "second" and "side".
Line 67, insert -- housing -- before the first "side"; and insert -- housing -- between "second" and "side".

Column 10,
Line 9, insert -- which rotates with rotation of said manual override shaft, -- between "portion," and "said".
Line 12, insert the following after "gate" -- such that said gate is translationally moveable in response to rotation of said manual override shaft. --
Line 46, insert the following after "stem" -- providing a rotatable control member for said manual override operator which is rotatable by a driver or an ROV; interconnecting said rotatable control member with said balance stem such that said balance stem is free for reciprocal movement in response to operation of said hydraulic operator so long as said rotatable control member is rotated to a position in which said manual override operator is not in operation, said manual override operator requiring only rotation of said rotatable control member by said driver or said ROV to thereby manually move said gate to a predetermined position whereupon said hydraulic operator is no longer functional. --

UNITED STATES PATENT AND TRADEMARK OFFICE

CERTIFICATE OF CORRECTION

PATENT NO. : 6,575,426 B2
DATED : June 10, 2003
INVENTOR(S) : Alagarsamy Sundararajan It is certified that error appears in the above-identified patent and that said Letters Patent is hereby corrected as shown below:

Column 11,
Line 21, insert the following claim, which was omitted in its entirety:
-- 25. A method for assembling a manual override control for a valve actuator assembly, said valve assembly comprising a gate valve with a gate moveable between a first position and a second position, an operating stem for a hydraulic actuator connecting to said gate and a balance stem connecting to said gate, said method comprising:
providing a manual override drive shaft with a threaded portion having left-handed threaded portion;
rotatably mounting said manual override drive shaft within a manual override housing;
mounting a connector element within said manual override housing for connecting with said gate; and
mounting said override drive shaft with respect to said connector element such that rotational movement of said drive shaft results in translational movement of said connector element. --
Line 21 (old), delete "25" and replace with -- 26 --; and delete "24" and replace with -- 25 --.
Line 24 (old), delete "26" and replace with -- 27 --; and delete "25" and replace with -- 26 --.
Line 25 (old), delete "ad".

Column 11 lines 32-38, through column 12, lines 1-13,
Delete all lines of entire Claim 27. It is a duplicate of Claim 28.

Column 12,
Line 15, insert -- having -- between “housing and “a”.

Signed and Sealed this

Sixth Day of July, 2004

JON W. DUDAS
*Acting Director of the United States Patent and Trademark Office*